US005281182A

United States Patent [19]

Yoneda et al.

[11] Patent Number: 5,281,182

[45] Date of Patent: Jan. 25, 1994

[54] REMOTE CONTROL ROBOT TOY WITH TORSO AND LEG TWIST AND TORSO TILT

[75] Inventors: Yosuke Yoneda; Masaru Tomiyama, both of Tokyo, Japan

[73] Assignee: Tomy Company, Ltd., Tokyo, Japan

[21] Appl. No.: 881,804

[22] Filed: May 12, 1992

[30] Foreign Application Priority Data

May 15, 1991 [JP] Japan ..... 3-44075

[51] Int. Cl.[5] ..... A63H 11/10; A63H 15/04; F41B 15/00

[52] U.S. Cl. ..... 446/289; 446/294; 446/273; 124/78

[58] Field of Search ..... 446/289, 290, 291, 293, 446/294, 279, 275, 273, 272, 269, 431, 436, 454, 456; 124/10, 78

[56] References Cited

U.S. PATENT DOCUMENTS

| | | | |
|---|---|---|---|
| 1,880,138 | 9/1932 | Hubl | 446/290 X |
| 3,083,504 | 4/1963 | Abbott | 446/291 |
| 3,128,575 | 4/1964 | Stanetzki | 446/291 X |
| 3,465,473 | 9/1969 | Nakamura | 446/269 |
| 3,648,408 | 3/1972 | Terzian et al. . | |
| 4,051,623 | 10/1977 | Ogawa . | |
| 4,507,043 | 3/1985 | Flatau | 446/390 X |
| 4,632,088 | 12/1986 | Bruce | 124/78 |
| 4,654,659 | 3/1987 | Kubo | 446/299 X |
| 4,708,688 | 11/1987 | Lee | 446/290 X |
| 4,723,932 | 2/1988 | Kelley et al. | 446/330 |
| 4,765,618 | 8/1988 | Daley | 124/78 X |
| 4,828,530 | 5/1989 | Lee | 446/330 X |

FOREIGN PATENT DOCUMENTS

| | | | |
|---|---|---|---|
| 2040708 | 9/1980 | United Kingdom | 446/290 |

*Primary Examiner*—David N. Muir
*Attorney, Agent, or Firm*—Staas & Halsey

[57] ABSTRACT

A radio controlled toy in which movement of the toy upon changing the travelling direction is natural and human-like. An upper body is mounted on a seat plate such that the upper body is twisted with respect to the seat plate. Two legs are mounted on the seat plate such that the direction thereof is changed with respect to the seat plate. The upper body and the two legs are interconnected by way of a link mechanism so that a twisting movement of the upper body and a direction changing movement of the two legs is performed in an interlocking relationship with each other. Further, a rotation controlling unit is provided for stopping rotation or reducing the speed of rotation of a wheel provided on an inner side of one of the two legs when a twisting movement of the upper body and a direction changing movement of the two legs are carried out. Since the upper body can be twisted when the travelling direction is changed to a direction to which the radio controlled toy is going to be turned with respect to the seat plate, the movement of the radio controlled toy becomes natural.

13 Claims, 9 Drawing Sheets

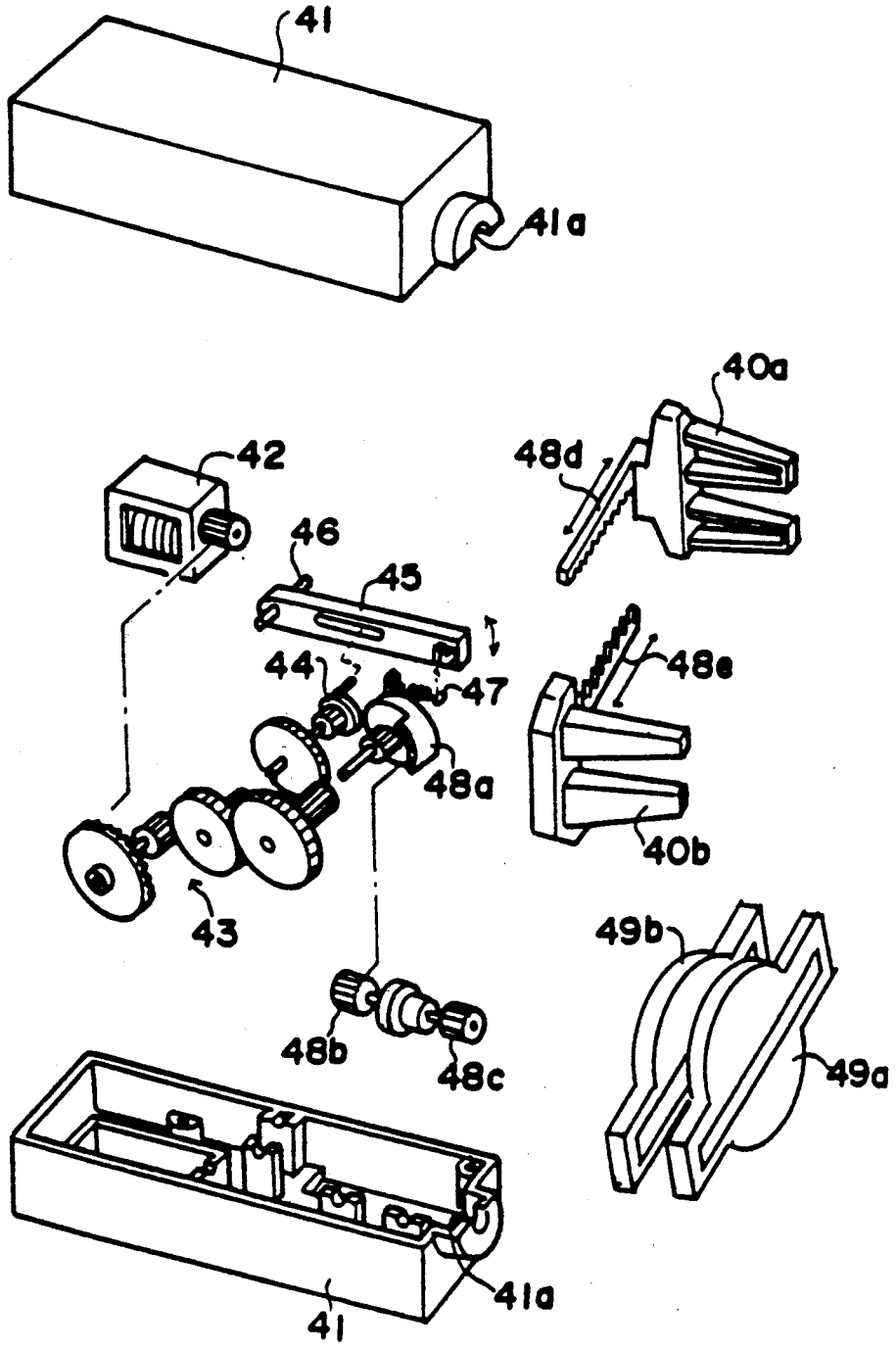
41
41a
40a
42
48d
46
45
44
47
48e
48a
40b
43
49b
48b
48c
49a
41a
41

REMOTE CONTROL ROBOT TOY WITH TORSO AND LEG TWIST AND TORSO TILT

BACKGROUND OF THE INVENTION

1. Field of the Invention

The present invention relates to a radio controlled toy constructed so that it is capable of changing its travelling direction in a smooth and natural manner.

2. Description of the Related Art

Radio controlled robot toys can be constructed so that they can change travelling direction. In such radio controlled robot toys, changing the travelling direction is normally performed by controlling the speed of rotation of wheels provided on lower sides of two legs. For example, reducing the speed of rotation of an inner side of one of the two wheels to zero or to a speed lower than that of an outer side wheel.

However, in such conventional toys, since the upper part and lower part of the robot are constructed as a unitary member, a twisting movement of the upper part with respect to the lower part cannot be performed upon changing the travelling direction. Rather, the travelling direction is changed such that the upper part remains directed substantially in the direction in which the toy was travelling while the lower part changes direction. This type of movement is unnatural.

SUMMARY OF THE INVENTION

It is an object of the present invention to provide a radio controlled toy wherein the style of movement upon changing the travelling direction is natural.

A radio controlled toy is constructed such that an upper body is mounted on a seat plate. The upper body can be twisted with respect to the seat plate. Two legs are mounted on the seat plate. Thus, the direction of the upper body can be changed with respect to the seat plate. The upper body and the two legs are interconnected by way of a link mechanism so that a twisting movement of the upper body and a direction changing movement of the two legs can be performed in an interlocking relationship with each other. Rotation controlling means is provided for stopping rotation or reducing the speed of rotation of a wheel provided on an inner side of one of the two legs wherein a twisting movement of the upper body and a direction changing movement of the two legs are performed.

A radio controlled toy is also constructed such that the seat plate of the radio controlled toy includes a seat plate body and a rocking plate mounted for rocking motion in upward and downward directions on the seat plate body. The upper body is mounted at a free end portion of the rocking plate.

According to the radio controlled toy of the present invention, since the upper body is twisted when changing the travelling direction to a direction to which the radio controlled toy is going to be turned with respect to the seat plate, the style of movement upon changing the travelling direction is natural. Further, since the direction of the legs is changed in an interlocking relationship with the twisting of the upper body, changing the travelling direction can be performed smoothly. In addition, if upward and downward movements of the upper body are performed in addition to twisting of the upper body, then the movement of the robot becomes human-like.

These objects, together with other objects and advantages which will be subsequently apparent, reside in the details of construction and operation, more fully hereinafter described and claimed, reference being had to the accompanying drawings forming a part hereof, wherein like reference numerals refer to like parts throughout.

BRIEF DESCRIPTION OF THE DRAWINGS

FIG. 10 is a fragmentary perspective view of a right arm of the radio controlled toy according to the embodiment of the present invention.

DESCRIPTION OF THE PREFERRED EMBODIMENT

An embodiment of a radio controlled toy according to the present invention will be described with reference to the drawings.

Figure 1:
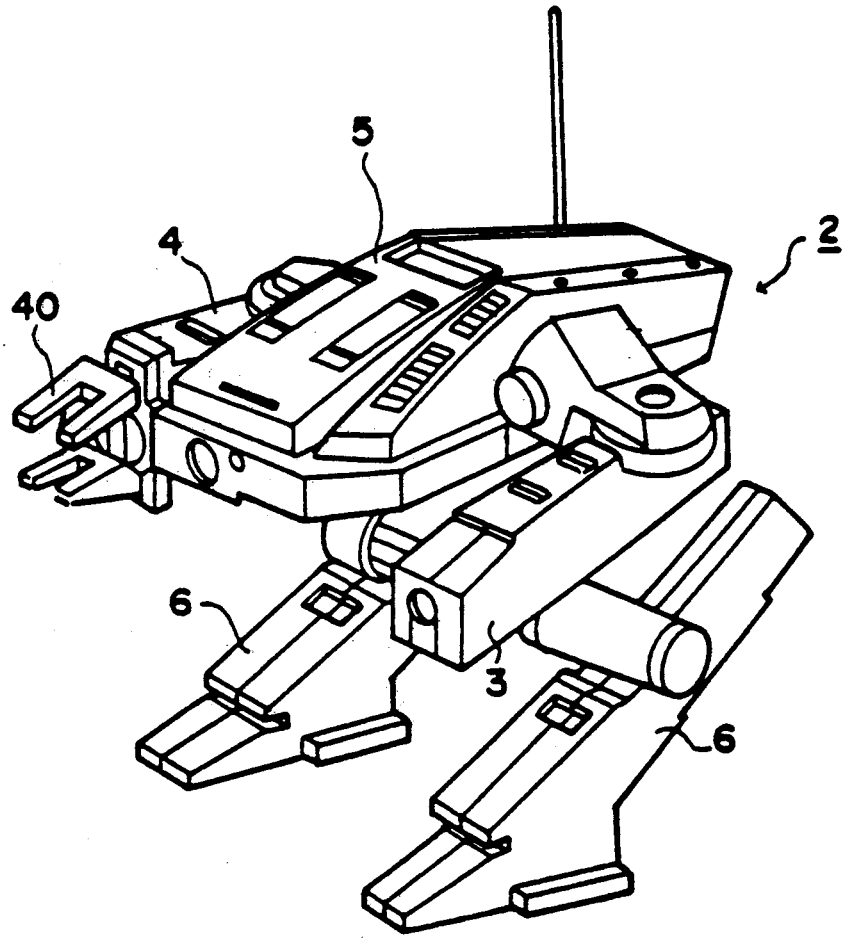
FIG. 1 is a perspective view of an entire radio controlled toy body according to an embodiment of the present invention.

FIG. 1 is a perspective view of an entire radio controlled toy according to the present invention. In FIG. 1, a radio controlled toy body 2 performs a forward or backward movement when an operator tilts, for example, a left-hand side stick 10 of a transmitter 1 (shown in FIG. 2) in a forward or backward direction. Meanwhile, when the stick 10 is tilted leftward, a pellet, for example, is shot from an end of a left arm 3. The end of the left arm can, however, include a light beam which is lit when the stick 10 is tilted leftward. When the stick 10 is tilted rightward, an opening or closing movement of a hand 40 at an end of a right arm 4 is performed. It is to be noted that, for example, when the stick 10 is tilted rightward and forward, a composite movement including a movement when the stick 10 is tilted rightward and another movement when the stick 10 is tilted forward, is performed. Further, when the stick 10 is tilted leftward and forward, rightward and backward or leftward and backward, a corresponding composite movement is performed.

Figure 2:
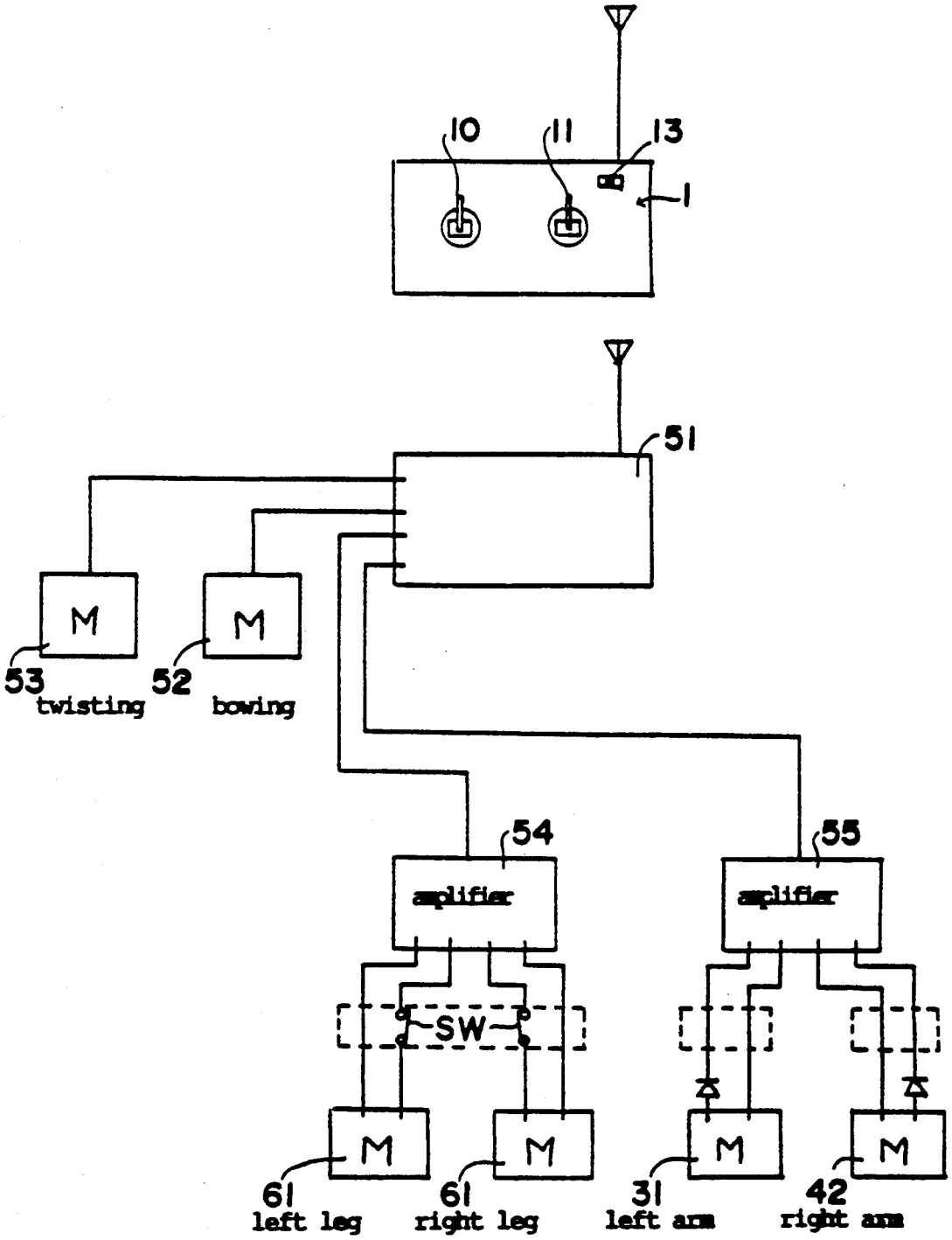
FIG. 2 is a block diagram of a controlling apparatus of the radio controlled toy according to the embodiment of the present invention.

In the meantime, when an operator tilts a right-hand side stick 11 of the transmitter 1 shown in FIG. 2 forward or backward, an upper body 5 of the radio controlled toy body 2 performs a bowing movement. On the other hand, when the stick 11 is tilted leftward or rightward, a leftward or rightward twisting movement of the upper body 5 and a leftward or rightward direction changing movement of the toes of two legs 6 is performed at the same time. It is to be noted that, when the stick 11 is tilted rightward and forward, leftward and forward, rightward and backward or leftward and backward, a corresponding composite movement is performed.

Further, when the left and right stick 10 and 11 of the transmitter 1 are both tilted in predetermined directions at the same time, all corresponding movements are performed in a composite manner. Reference numeral 13 of the transmitter 1 shown in FIG. 2 denotes a main switch.

Details of the radio controlled toy body 2 will now be described with respect to FIGS. 3 and 4.

The radio controlled toy body 2 is basically constructed from two legs 6 (FIG. 1), a seat plate 7 (FIGS. 3 and 4) and the upper body 5. The radio controlled toy body 2 has a structure such that the upper body 5 is mounted for pivotal motion on the seat plate 7 in such a manner as to allow the upper body 5 to be twisted while the two legs 6 are mounted for pivotal motion on the seat plate 7 so that the direction of the toes of the two legs 6 can be changed. Further, the structure is such that the upper body 5 and the two legs 6 are interconnected by way of a link mechanism 80 (refer to FIG. 5) composed of a pair of links 80*a* and 80*b* so that a twisting movement of the upper body 5 and a direction changing movement of the two legs 6 may be performed in an interlocking relationship with each other. An Ackermann mechanism is constructed by the above-mentioned connection of the upper body 5 and the two legs 6 by way of the link mechanism 80.

Figure 3:
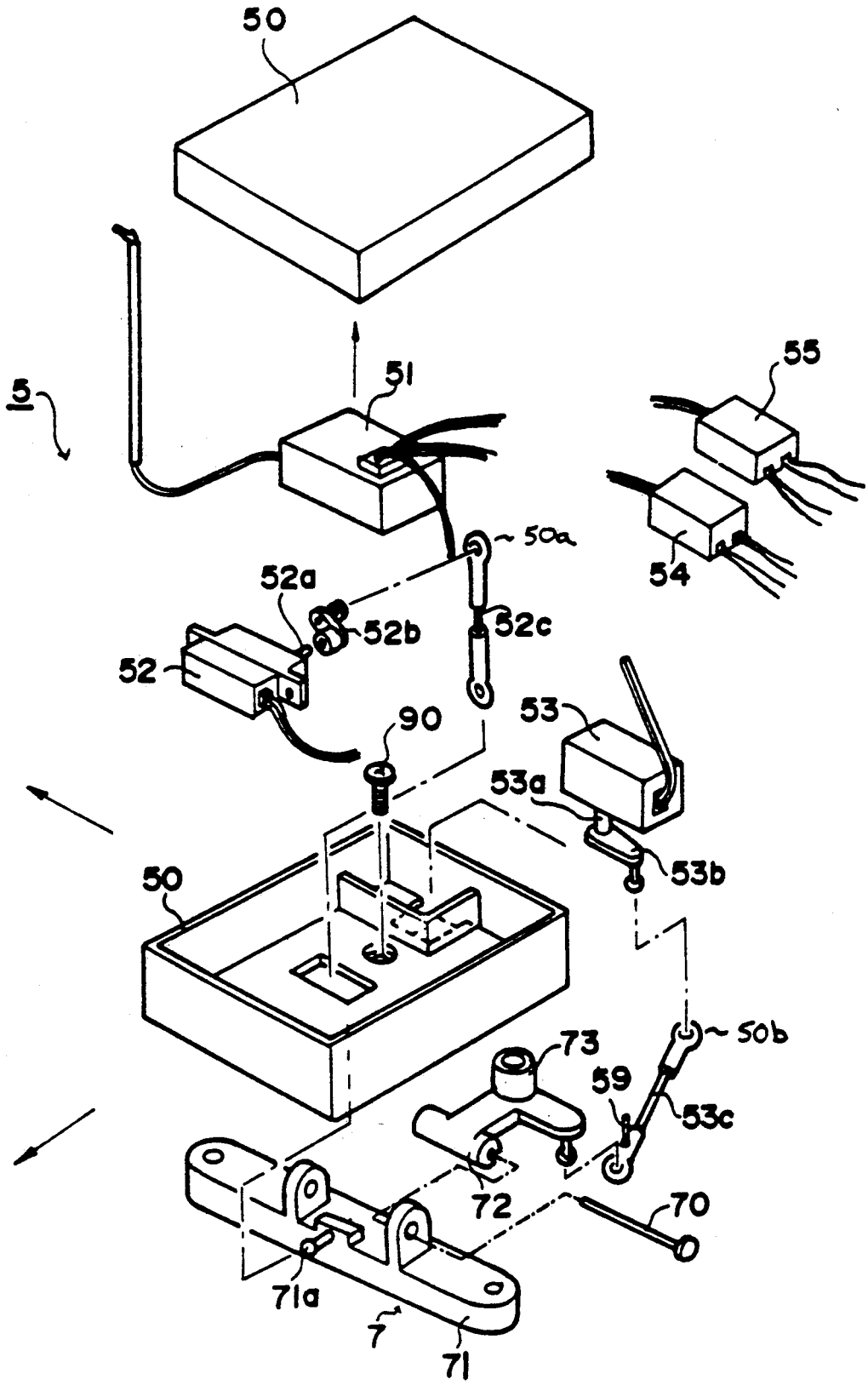
FIG. 3 is a fragmentary perspective view of a seat plate and part of an upper body of the radio controlled toy according to the embodiment of the present invention.
Figure 4:
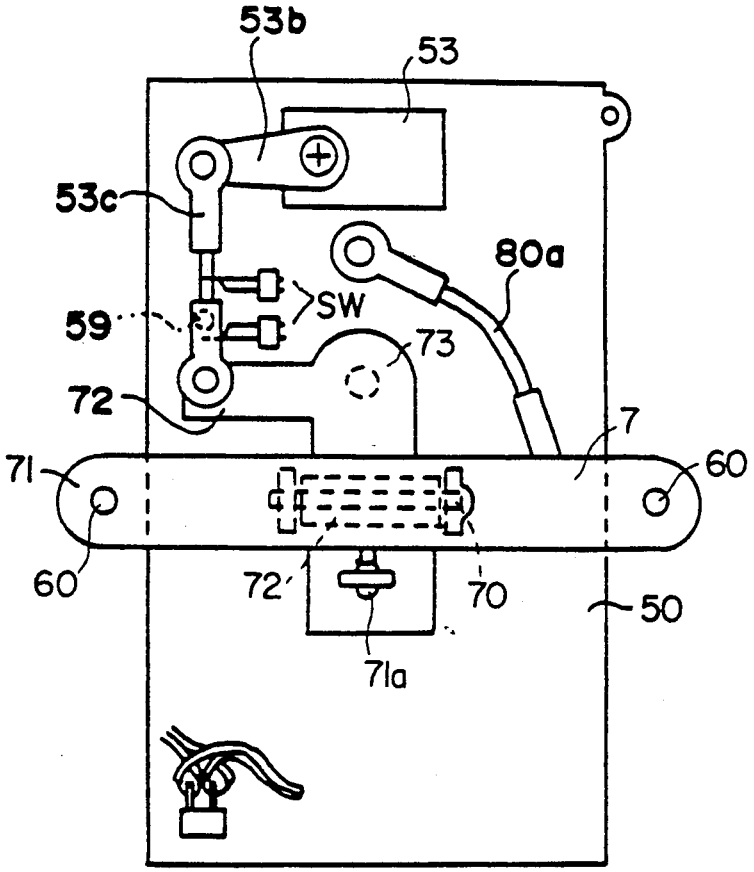
FIG. 4 is a bottom plan view of the radio controlled toy body according to the embodiment of the present invention.
Figure 5:
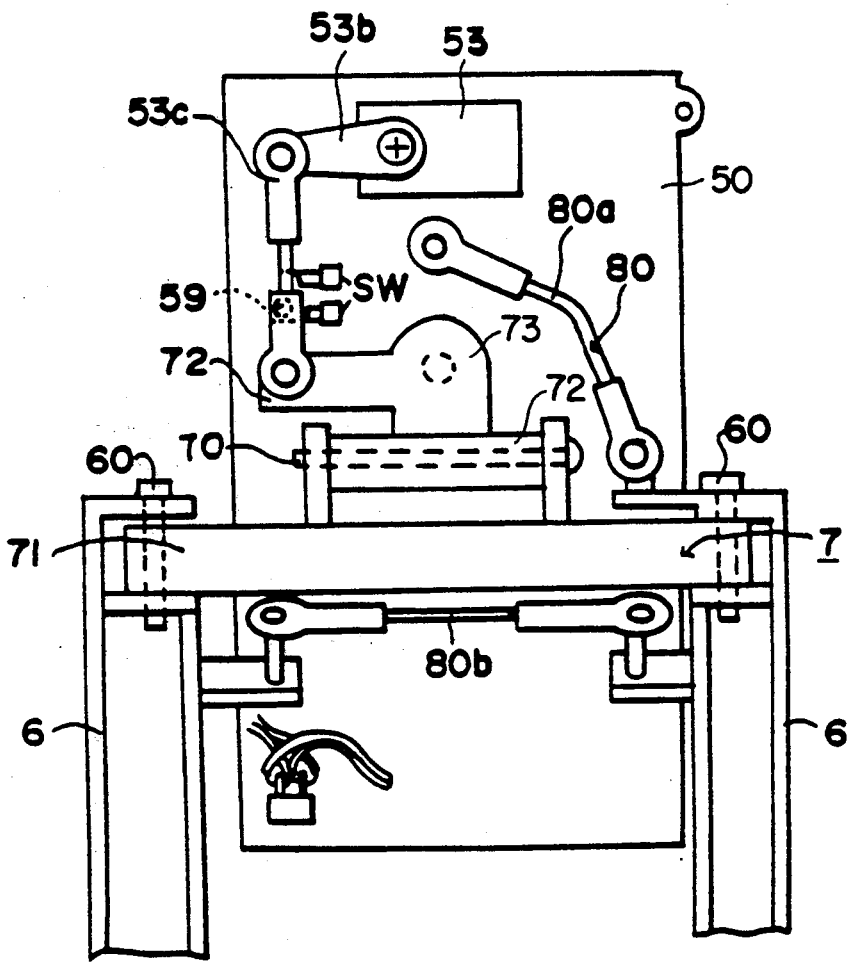
FIG. 5 is a rear partial view of the radio controlled toy body according to the embodiment of the present invention when the upper body is tilted fully forward.

The seat plate 7 is composed of, as shown in FIGS. 3 to 5, a seat plate body 71 and a rocking body 72 mounted for upward and downward rocking motion around a shaft 70 on the seat plate body 71. The upper body 5 is mounted for leftward and rightward pivotal motion around another shaft 73 at a free end portion of the rocking body 72 of the seat plate 7. In FIG. 3, reference numeral 90 denotes a machine screw used to mount the upper body 5 for pivotal motion on the shaft 73. Further, the two legs 6 are mounted for pivotal motion on the opposite sides of the seat plate body 71 by means of pins 60 (FIG. 5).

In a pair of upper and lower cases 50 installed in the upper body 5, a 4-channel receiver 51 for receiving a signal from the transmitter 1 and a pair of servomotors 52 and 53 which are controlled by the receiver 51 are installed as shown in FIG. 3. One of the servomotors 52 is provided to drive the upper body 5 to perform a bowing movement. An end of a driving link 52*b* which is pivoted by forward or reverse rotation of the servomotor 52 is attached to a shaft 52*a* of the servomotor 52 while an end of a driven link 52*c* is attached to the other end of the driving link 52*b* through an opening 50*a*. The other end of the driven link 52*c* is attached to a pin 71*a* provided on the seat plate body 71. Accordingly, when the driving link 52*b* is pivoted by forward or reverse rotation of the servomotor 52, the upper body 5 will perform a rocking movement (bowing movement) in upward and downward directions around the shaft 70.

The other servomotor 53 is provided to twist the upper body 5 leftward or rightward. One end of a driving link 53*b* which projects from an opening 50*b* and is pivoted by forward or reverse rotation of the servomotor 53 is attached to a shaft 53*a* of the servomotor 53 while an end of a driven link 53*c* is attached to the other end of the driving link 53*b*. The other end of the driven link 53*c* is attached to a free end portion of the rocking body 72. Accordingly, when the driving link 53*b* is pivoted by forward or reverse rotation of the servomotor 53, the upper body 5 will perform a pivoting movement (twisting movement) in a leftward or rightward direction around the shaft 73. Further, a travelling amplifier 54 is provided in the upper and lower cases 50 installed on the upper body 5. The travelling amplifier 54 is connected to a motor 61 (FIG. 6) by way of a normally closed leaf switch SW (FIGS. 2, 4 and 5) installed in each leg 6, forming a rotation controlling means. The leaf switches SW are mounted on a lower face of the upper body 5 and are alternately opened, upon changing the travelling direction, by a pin 59 provided on an upper face of the driven link 53*c*. In this condition, since the motor 61 on the opened switch SW side (on an inner side of a direction to which the radio controlled toy is going to be turned) is placed in an inoperative condition, a driving wheel 63 provided on the switch SW side will be placed in a stopping condition. Since the motor 61 of the closed switch SW side (on an outer side of a direction to which the radio controlled toy is going to be turned) is placed in an operative condition, a driving wheel 63 (FIG. 6) provided on the leg 6 will be placed in a rotatable condition. Accordingly, when the radio controlled toy is in this condition, if an operator tilts the left-hand side stick 10 of the transmitter 1 forward or backward, then the radio controlled toy body 2 will be turned toward the side to which the upper body 5 is directed.

It is to be noted that, regarding a process of transmission of power from the motor 61 to the driving wheel 63, a driving force of the motor 61 is transmitted by way of stage gears 64*a*, 64*b*, 64*c*, 64*d*, 64*e* and 64*f* to the driving wheel 63. The driving wheel 63 is made of rubber and is integrally rotatable with the last stage gear 64*f*.

Figure 6:
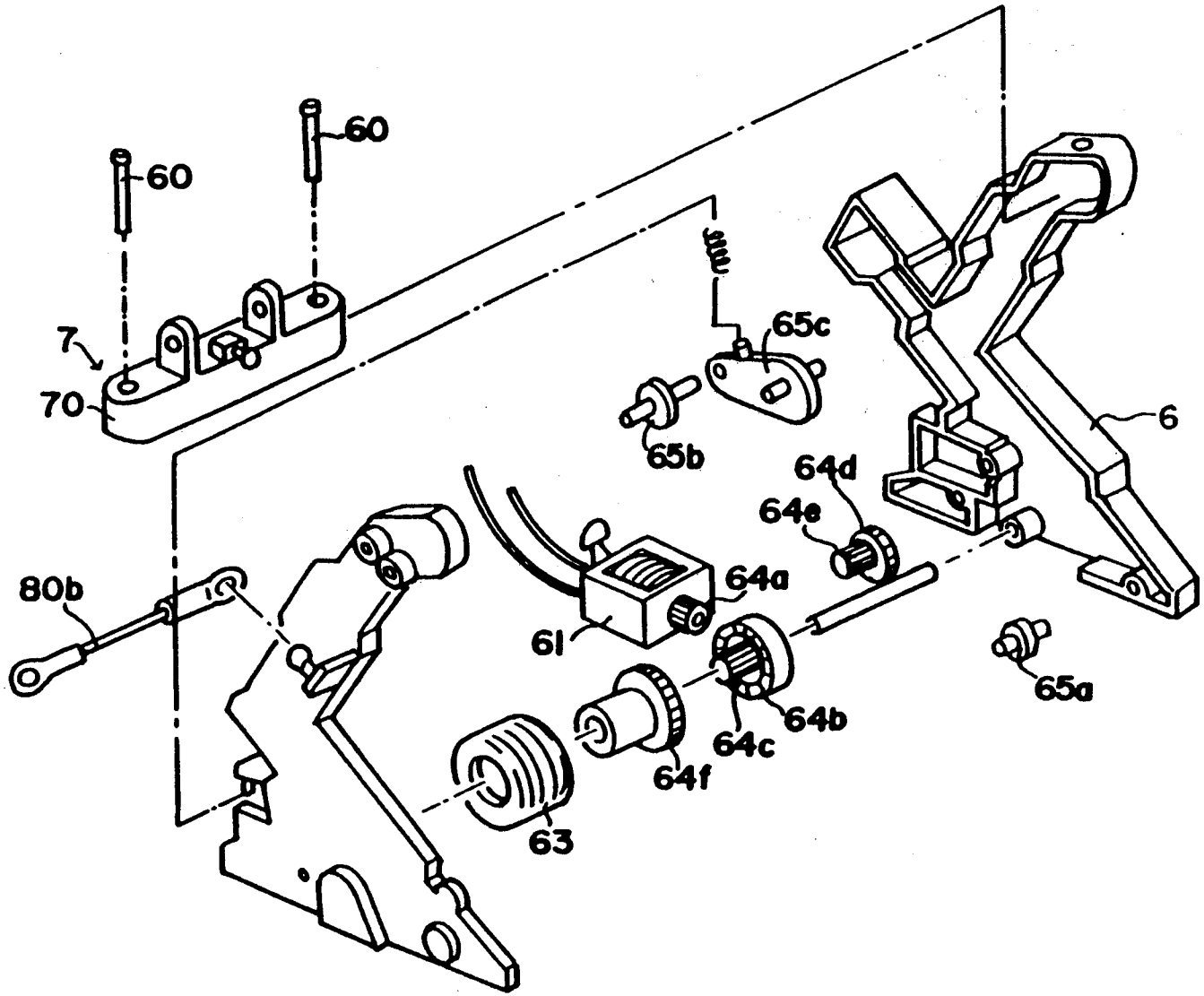
FIG. 6 is a fragmentary perspective view of a leg of the radio controlled toy according to the embodiment of the present invention.
Figure 7:
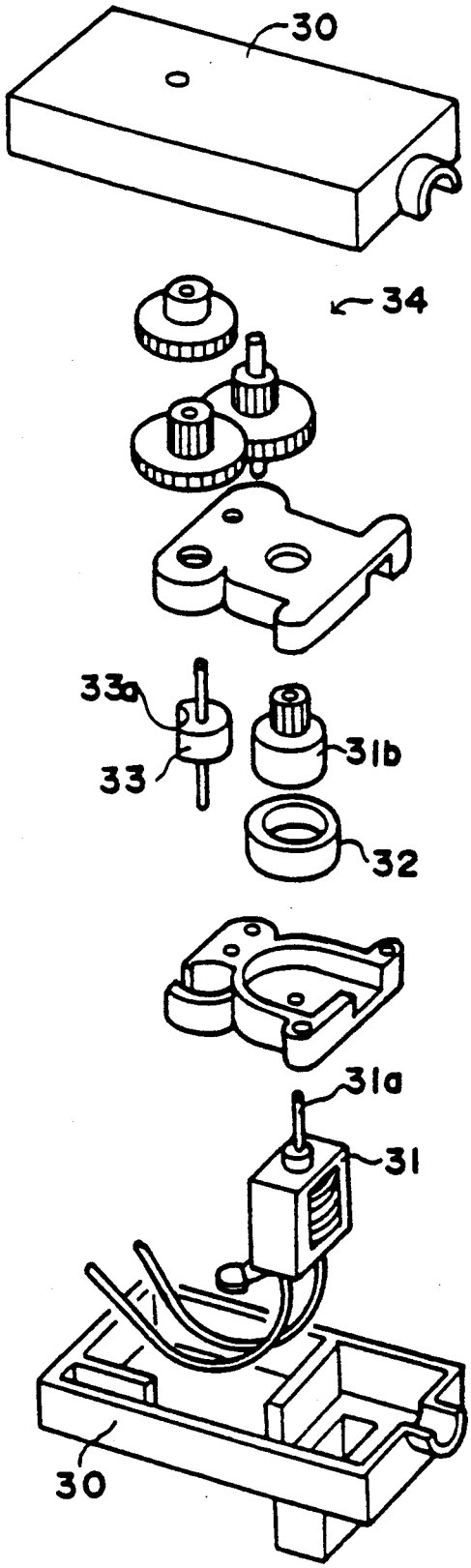
FIG. 7 is a fragmentary perspective view of a left arm of the radio controlled toy according to the embodiment of the present invention.
Figure 8:
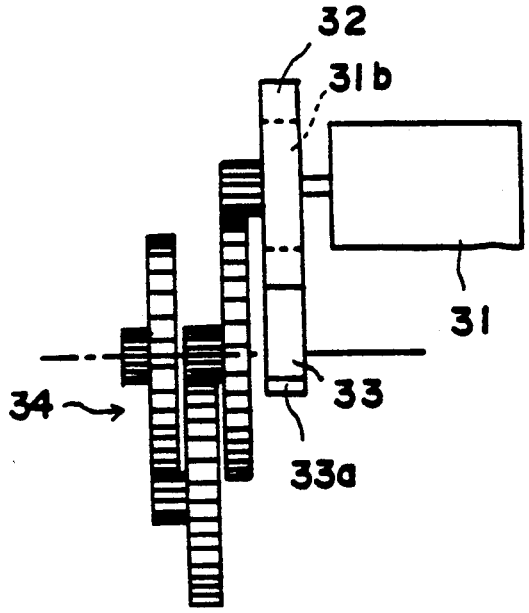
FIG. 8 is a side view of gears of pellet shooting mechanism of the left arm of the radio controlled toy according to the embodiment of the present invention.
Figure 9:
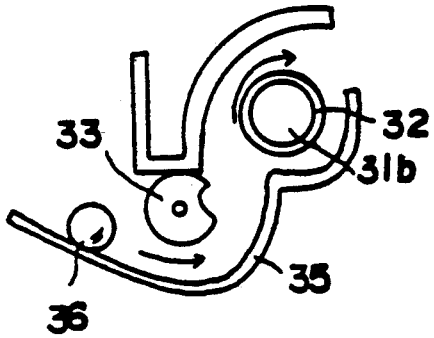
FIG. 9 is a diagram of a mechanism for shooting pellet out of the left arm of the radio controlled toy according to the embodiment of the present invention.

Further, in FIG. 6, reference character 65*a* denotes a front side auxiliary wheel, reference character 65*b* denotes a rear side auxiliary wheel, and reference character 65*c* denotes a suspension on which the rear side auxiliary wheel 65*b* is supported. An arm operating amplifier 55 (FIG. 3) is installed in the upper and lower cases 50. The arm operating amplifier 55 is first connected to a motor 31 in a case 30 installed in the left arm 3 (FIG. 7). The case 30 of the left arm 3 is removably mounted on the upper body 5. That is, other arms, such as arms having a light on one end, can be easily interchanged. In this mounted condition, the arm operating amplifier 55 and the motor 31 can be automatically connected to each other by means of a connector (not shown) as indicated by a broken line in FIG. 2. A pellet shooting mechanism or light mechanism is installed in the case 30. In FIGS. 7 to 9, a pellet shooting mechanism is described. The pellet shooting mechanism is constructed, for example, from a rubber roller 33 which is rotated by the motor 31 by way of a gear train 34 and has a pellet holding recessed portion 33*a*. A roller 31*b* is mounted on a shaft 31*a* of the motor 31 and has a rubber ring 32 fitted thereon. The connection of these elements is shown in FIG. 8. As shown in FIG. 9, bullets 36 are loaded in a pellet supplying drum 35 and collected at a lower location. The pellets 36 are pushed up by the roller 31*b* and are shot by the rubber ring 32 fitted on the roller 31*b*. The pellets are made, for example, of plastic, and can have a variety of shapes.

Meanwhile, the arm operating amplifier 55 is connected to a motor 42 in a case 41 installed in the right arm 4 (FIG. 10). The case 41 of the right arm 4 is removably mounted on the upper body 5. In this mounted condition, the arm operating amplifier 55 and the motor 42 are automatically connected to each other by a connector (not shown) as indicated by a broken line in FIG. 2. An opening and closing mechanism for the hand 40 is installed in the case 41. In the opening and closing mechanism, a power of rotation of the motor 42 is transmitted to an eccentric cam 44 by way of a gear train 43 to rock a rocking body 45 around a shaft 46. Further, a gear 48*a* having a crown formed partly thereon is pivoted intermittently by an action of a spring 47 having an end anchored at an end of the rocking body 45 to rotate gears 48*b* and 48*c* to open or close hands 40*a* and 40*b* movably mounted on racks 48*d* and 48*e*. Here, the racks 48*d* and 48*e* are installed in a pair of engaging rack holding plates 49*a* and 49*b* and are held in meshing engagement through an opening of the rack holding plate 49*a* with the gear 48*c* exposed in the rack holding plates 49*a* and 49*b*. Further, pawls (not shown) are formed at side portions of the racks 49*a* and 49*b*. The pawls are removably engaged with the hands 40*a* and 40*b* through an opening of the rack holding plate 49*b*. It is to be noted that the pair of rack holding plates 49*a* and 49*b* are removably engaged at a disk-shaped engaging portion (not shown) formed at a rear face of the rear side rack holding plate 49*a* for pivotal motion in an engaging hole 41*a* at an end of a lower portion of the case 41.

According to the radio controlled toy of the present invention constructed in the above-mentioned manner, the following advantages are attained. In particular, since the upper body 5 can be twisted when changing the travelling direction to a direction to which the radio controlled toy is going to be turned, the style of movement upon changing the travelling direction becomes natural and human-like. Further, since the direction of the legs 6 is changed in an interlocking relationship with the twisting of the upper body 5, changing the travelling direction can be performed smoothly. Since an opening or closing movement of the hand 40 of the right arm 4 is performed by engaging the racks 48*d* and 48*e* with the gear (pinion) 48*c* from opposite sides and the racks 48*d* and 48*e* can be pivoted by way of the rack holding plate 49*a*, the opening or closing direction of the hand 40 can be changed freely to an upward or downward direction or to a leftward or rightward direction by twisting the rack holding plates 49*a* and 49*b*. In addition, since the motors are built in the arms 3 and 4 and connection between the amplifiers in the upper body 5 and the motors is established by attaching the arms 3 and 4 to the upper body 5, the arms 3 and 4 can be formed as a unit. Thus, the arms 3 and 4, having various functions, can be attached in a simple manner and can be easily changed.

While the present invention has been described so far in connection with the above embodiment, the present invention is not limited to the embodiment described above. It is a matter of course that various modifications can be made thereto without departing from the spirit and scope of the invention. For example, according to the radio controlled toy of the embodiment described above, since the upper body 5 performs a bowing movement, the upper body 5 may be mounted directly on the seat plate 7 which is constructed only from the seat plate body 70. In addition, the radius of curvature with which the radio controlled turns can be changed arbitrarily by changing a location and/or a length of the link 80*a* forming the link mechanism 80. Further, in the radio controlled toy of the above-mentioned embodiment, the opening or closing direction and/or the pellet shooting direction of the hand 40 may be changed by radio control. Also, the upper body 5 may be pivoted leftward or rightward by means of a gear mechanism or some other mechanism and the speeds of rotation of the left and right wheels may be differentiated from each other by using the amplifier 54 for a left or right leg without provision of the switches SW.

According to the present invention, when changing the travelling direction, since the upper body can be twisted in a direction to which the toy is going to be turned with respect to a seat plate, the movement of the robot toy upon changing the travelling direction becomes natural and human-like. Further, since the direction of the legs is changed in an interlocking relationship with the twisting of the upper body, a travelling direction change is performed smoothly. If upward and downward movements of the upper body are performed in addition to twisting of the upper body, then a natural, human-like movement will be further promoted.

What is claimed is:

1. A radio controlled toy capable of changing a travelling direction thereof, comprising:

a seat plate having an essentially normal axis;

an upper body mounted by body mounting means on said seat plate such that said upper body can be twisted about said seat plate axis with respect to said seat plate;

two legs, each of said two legs having a wheel provided on an under side, each leg mounted on a leg axis where each leg axis is essentially parallel to said seat plate axis, each of said two legs mounted on said seat plate by pin hinge means such that the direction of said two legs can be changed about said leg axis with respect to said seat plate, said upper body and said two legs being interconnected by way of a link mechanism so that a twisting movement of said upper body and a direction changing movement of said two legs can be performed in an interlocking relationship with each other; and rotation controlling means for stopping rotation or reducing the speed of rotation of said wheel provided on the under side of one of said two legs in a condition such that a twisting movement of said upper body and a direction changing movement of said two legs are performed.

2. A radio controlled toy according to claim 1, wherein said seat plate comprises:

a seat plate body; and a rocking plate, mounted to said seat plate body, allowing a rocking motion in upward and downward directions on said seat plate body, said upper body being mounted at a free end portion of said rocking plate.

3. A radio controlled toy according to claim 2, wherein said rotation controlling means comprises:

a travelling amplifier located in said upper body; and a motor in each one of said two legs connected to said travelling amplifier.

4. A radio controlled toy according to claim 3, further comprising a shaft located at said free end portion of said rocking plate, wherein said upper body is mounted for pivotal motion around said shaft.

5. A radio controlled toy according to claim 4, further comprising pins located on opposite ends of said seat plate body, wherein said two legs are mounted for pivotal motion to said pins.

6. A radio controlled toy according to claim 5, further comprising servomotors provided in said upper body.

7. A radio controlled toy according to claim 6, wherein said servomotors comprise a first servomotor driving said upper body to perform a bowing movement and a second servomotor twisting said upper body leftward and rightward.

8. A radio controlled toy according to claim 7, further comprising:

a receiver in said upper body for receiving a signal from a transmitter and wherein each one of said two legs includes an amplifier connected to said receiver.

9. A radio controlled toy according to claim 8, wherein said upper body and said two legs are interconnected by way of link means.

10. A radio controlled toy according to claim 9, wherein said link means comprises a link mechanism including a pair of links.

11. A radio controlled toy according to claim 10, further comprising:

arms attached to said upper body; and a motor included in each arm.

12. A radio controlled toy according to claim 11, wherein a first one of said arms includes opening and closing means for grasping, said opening and closing means opening and closing in one of a right and left direction and an upward and downward direction.

13. A radio controlled toy according to claim 12, wherein a second one of said arms includes pellet shooting means for shooting pellets therefrom.

* * * * *